United States Patent [19]

Nelson

[11] Patent Number: 4,872,520

[45] Date of Patent: Oct. 10, 1989

[54] FLAT BOTTOM DRILLING BIT WITH POLYCRYSTALLINE CUTTERS

[75] Inventor: Jack R. Nelson, Houston, Tex.

[73] Assignee: Triton Engineering Services Company, Houston, Tex.

[21] Appl. No.: 256,934

[22] Filed: Oct. 13, 1988

Related U.S. Application Data

[63] Continuation of Ser. No. 004,380, Jan. 16, 1987, abandoned.

[51] Int. Cl.[4] ..... E21B 10/46

[52] U.S. Cl. ..... 175/329; 175/410

[58] Field of Search ..... 175/329, 378, 393, 410, 175/412, 413, 417

[56] References Cited

U.S. PATENT DOCUMENTS

| | | | |
|---|---|---|---|
| Re. 32,036 | 11/1985 | Dennis | 175/329 |
| 3,027,952 | 4/1962 | Brooks | 175/329 X |
| 4,429,755 | 2/1984 | Williamson | 175/410 X |
| 4,550,791 | 11/1985 | Isakov | 175/410 |
| 4,558,753 | 12/1985 | Barr | 175/329 |
| 4,570,726 | 2/1986 | Hall | 175/410 |

FOREIGN PATENT DOCUMENTS

| | | | |
|---|---|---|---|
| 0117241 | 8/1984 | European Pat. Off. | 175/329 |

*Primary Examiner*—William P. Neuder

*Attorney, Agent, or Firm*—Fulbright & Jaworski

[57] ABSTRACT

An earth drilling bit with a body having a flat bottom. A plurality of cutting elements positioned on the flat bottom including a polycrystalline diamond cutter. The cutters include an elongate apex with a face on both sides of the apex extending backwardly from the apex. The apex extends generally vertically with a slight rake for providing a chisel surface for acting on the earth even when when the cutter becomes worn. The cutter may include multiple apexes and have zero side rake. A plurality of fluid circulating channels are provided in the flat bottom and vertically along the outside of the body and a plurality of fluid nozzles are directed outwardly at an angle to the longitudinal axis of the body.

4 Claims, 3 Drawing Sheets

FLAT BOTTOM DRILLING BIT WITH POLYCRYSTALLINE CUTTERS

This is a continuation of application Ser. No. 004,380 filed 1/16/87 now abandoned.

BACKGROUND OF THE INVENTION

It is well known to utilize an earth drilling bit having a body with a threaded pin on its upper end for connection to a drilling string for drilling oil and/or gas wells. One type of drilling bit, such as shown in U.S. Pat. No. 4,558,753, utilizes a plurality of cutting elements having a stud formed of one material, mounted onto and projecting from the bit cutting face, and carrying a bonded polycrystalline diamond cutting tool (PDC) for engaging the earth to be bored. Such cutting elements are generally flat or concave. However, as the drill bit is used, wear occurs to the relatively sharp cutting edges of the cutter which consequentially results in flat surfaces. The total flat area of the cutters contacting the formation increases as rotation continues, generating undesirable excessive heat and torque that prematurely shortens the bit effectiveness and life.

Because the earth formation includes different strata some of which are extremely hard and some of which are relatively soft, it has been difficult to design a cutting element that will drill efficiently through stratified formations while at the same time reducing damage and wear to the cutting elements. Various solutions that have been proposed are staggering the heights of the cutting elements, varying the side and back rake of the cutting faces, providing concave cutting faces to provide various values of back rake angles. However, in all of these proposed solutions, the tips of the cutting elements wear flat and generate non-productive friction that dramatically shortens the drill bit life. Furthermore, while fluid circulation systems are employed in PDC bits for circulating drilling fluid through the bit for bottom hole cleaning, cooling the cutter elements and transporting the cuttings from beneath the bit to the well annulus for circulation out of the hole, such systems do not optimize the effectiveness of the circulation system.

SUMMARY

The present invention is directed to an earth drilling bit having a body in which the body includes a flat bottom. A plurality of cutting elements are positioned on the flat bottom and the elements include a stud carrying a polycrystalline diamond cutter. Each cutter includes an elongate apex with a face on both sides of the apex extending backwardly from the apex. The apex extends generally vertically with a slight back rake for providing a chisel surface for acting on the earth even when the cutter becomes worn.

Still a further object of the present invention is wherein the cutters may include multiple apexes with a face extending backwardly on both sides of each apex for more effectively drilling in hard formations.

Still a further object of the present invention is wherein the apexes are straight and have a zero side rake.

Still a further object of the present invention is wherein the body includes a fluid passageway and a plurality of fluid circulating channels in communication with the passageway extending horizontally in the flat bottom and vertically along the outside of the body.

Yet a still further object of the present invention is wherein the body includes a fluid passageway having a plurality of nozzles positioned in the flat body in communication with the passageway. The nozzles are directed inwardly at an angle to the longitudinal axis of the body.

Still a further object of the present invention is wherein the plurality of cutting elements are all in the same horizontal plane.

Yet a still further object of the present invention is wherein the plurality of cutting elements include both single and multiple apex cutters, the cutting elements are all in the same horizontal plane, and preferably the single apex cutters are alternately positioned outwardly in a radial direction from the horizontal axis of the body with the multiple apex cutters.

Other further objects, features and advantages will be apparent from the following description of a presently preferred embodiment of the invention, given for the purpose of disclosure, and taken in conjunction with the accompanying drawings.

DESCRIPTION OF THE PREFERRED EMBODIMENT

Figure 1:
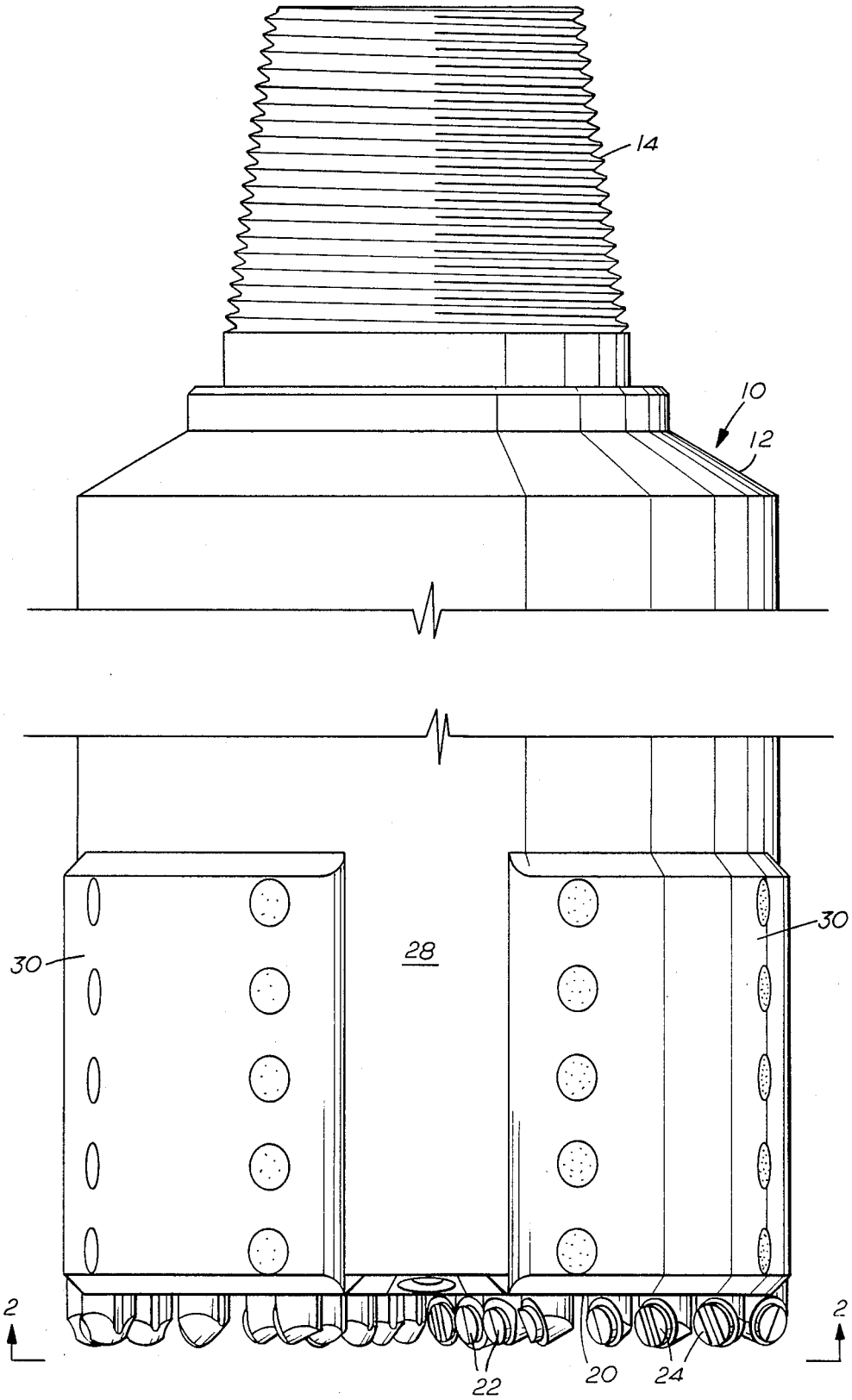
FIG. 1 is an elevational view of the drilling bit of the present invention.
Figure 3:
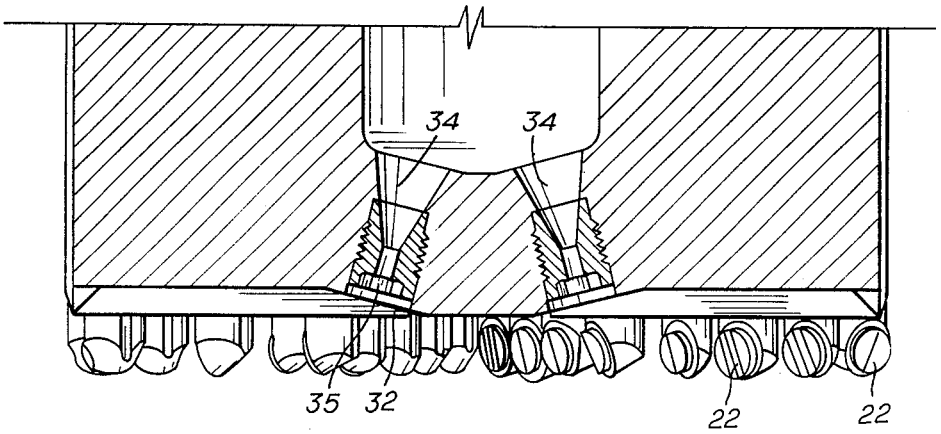
FIG. 3 is a cross-sectional view taken along line 3—3 of FIG. 2.
Figure 2:
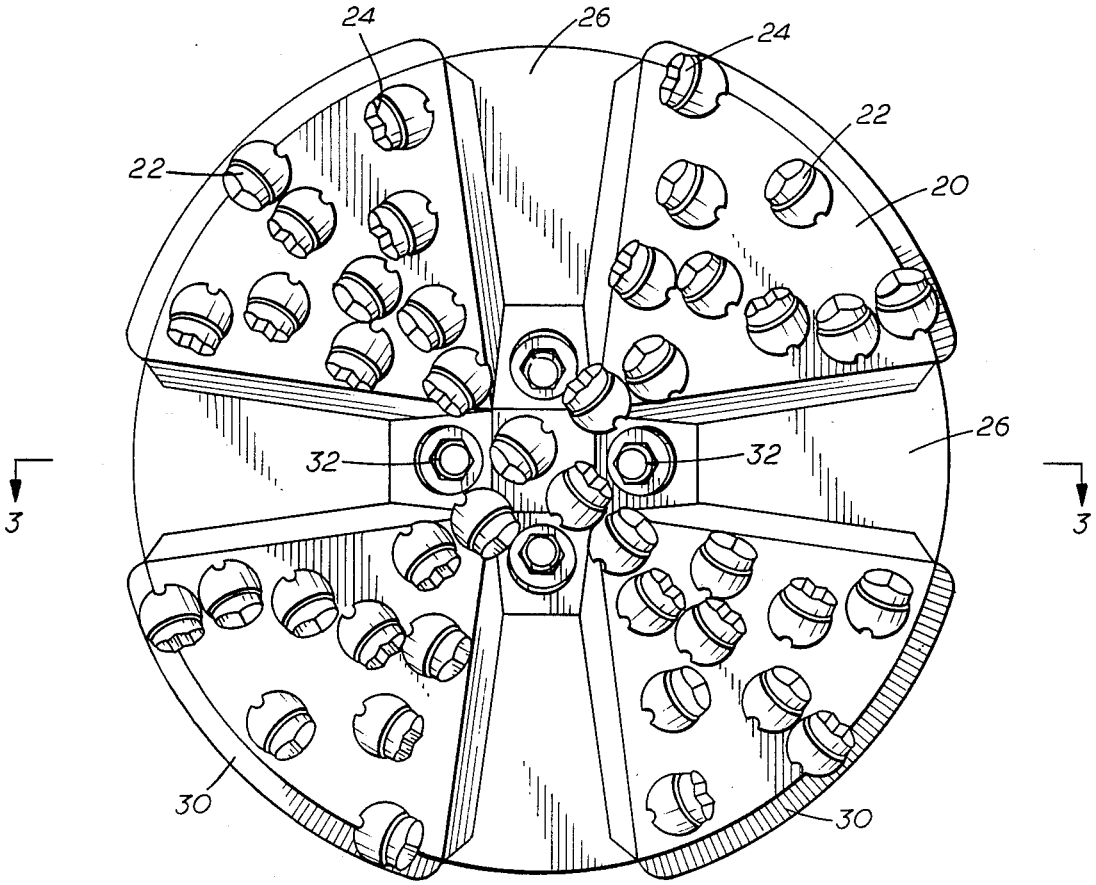
FIG. 2 is a view taken along the line 2—2 of FIG. 1.

Referring now to the drawings, and particularly to FIGS. 1, 2 and 3, the reference numeral 10 generally indicates the earth drilling bit of the present invention which includes a body 12, such as forged steel, and a threaded pin 14 on its upper end for connection to a conventional drill string. The body 12 includes a fluid passageway 16 FIG. 3) for receiving drilling fluid from the drill string.

The body 12 includes a flat bottom 20. A plurality of cutting elements types 22 and 24, either one or both types may be used, are mounted into holes in the bottom 20 and will be more fully described hereinafter.

A plurality of fluid circulating channels, such as four, are provided which include horizontally extending channels 26 in the flat bottom 20 and vertically extending channels 28 on the outside of the body 12 between stabilizer plates 30. The circulating channels receive fluid from the fluid passageway 16 for washing the cuttings generated by the cutting elements 22 and 24 into the well annulus and back to the well surface. A plurality of nozzles 32 are provided which are connected to nozzle passageways 34 that are connected to fluid passageway 16. The nozzles 32 are positioned in the bottom 20 for discharging drilling fluid from the passageway 16 into the well bore for cleaning the well bore, directing the cuttings into the horizontal channels 26 and vertical channels 28, and for cooling the cutting elements 22 and 24. Normally, bit nozzles are directed perpendicularly to the earth which impacts and compacts the earth formation being drilled. Preferably, the nozzles 32 are directed outwardly toward the outer edge at an angle of 15° with respect to the vertical for reducing the impact on the drilling surface. The nozzles 32 may be formed of tungsten carbide and of the screw type having a socket 35 for insertion and removal.

Figure 4:
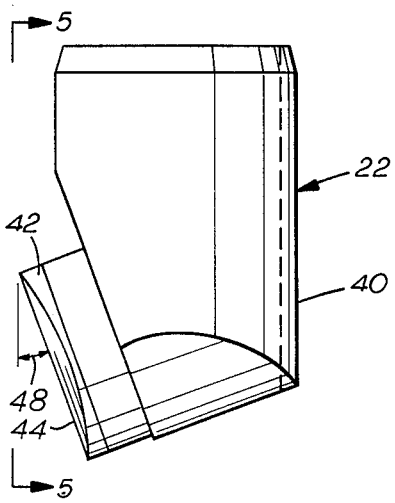
FIG. 4 is an elevational view of one type of cutting element.
Figure 5:
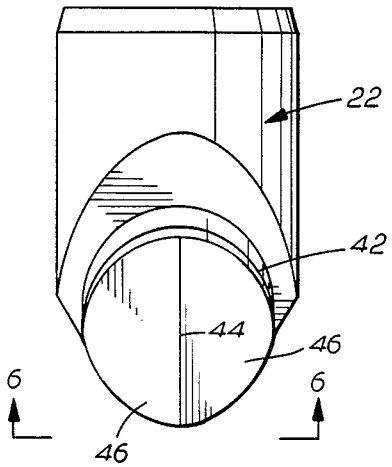
FIG. 5 is a view taken along the line 5—5 of FIG. 4.
Figure 6:
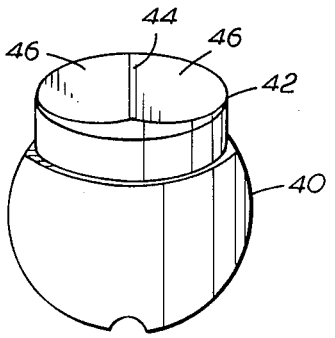
FIG. 6 is a view taken along the line 6—6 of FIG. 5.

Referring now to FIGS. 4, 5 and 6, one type of cutting element 22 is best seen having a body or stud 40 which is secured in a hole in the bottom plate 20 and which includes a polycrystalline diamond cutter 42 bonded to the stud 40. The cutter 42 includes an elongate, preferably straight apex 44 which is positioned at the leading edge of the cutter 42, as best seen in FIG. 2, in the direction of rotation of the bit 10. A face 46 is provided on the cutter 42 on both sides of the apex 44 and extends backwardly from the apex 44. Preferably, the faces 46 are flat although they could be concave surfaces. It is particularly noted that the apex 44 extends generally vertically for providing a chisel surface for acting on the earth even when the cutter 42 becomes worn. Preferably the cutter 42 has a slight back rake 48. While the amount of back rake may vary depending upon the types of formations being drilled, 10° back rake is satisfactory. It is also noted that the cutter 42 preferably has a zero side rake. The cutter 42 is positioned to provide a positive cutting action and minimize slipping on hard formations. It is to be particularly noted that even though the cutting element 22 is worn down at its outer tip that the apex 44 continues to provide a sharp chiseling action which is maintained until the entire section of the cutter 42 is worn out. This chisel shape of the apex 44 induces a fracturing, scraping and shearing action on the drilled formation rather than the typical conventional shearing action.

Figure 7:
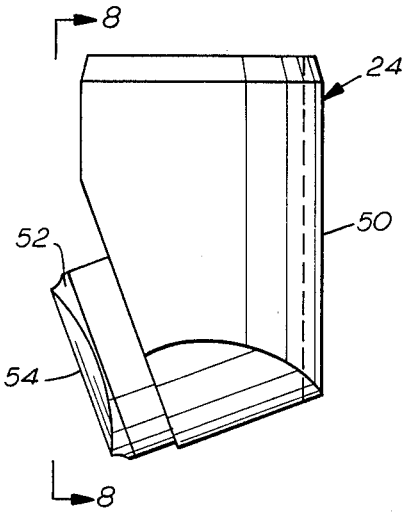
FIG. 7 is an elevational view of another type of cutting element.
Figure 8:
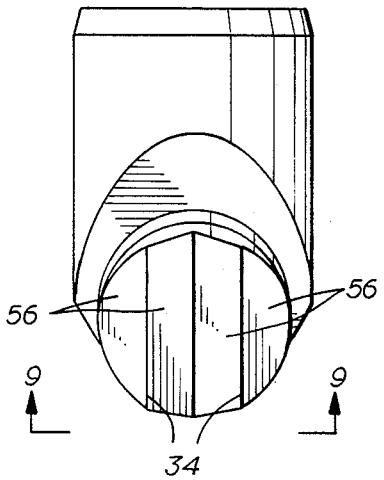
FIG. 8 is a view taken along the line 3—3 of FIG. 7.
Figure 9:
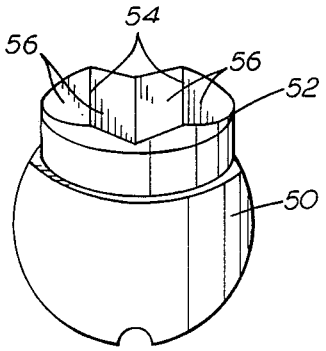
FIG. 9 is a view taken along the line 9—9 of FIG. 8.

Referring now to FIGS. 7, 8 and 9, another type of cutting element 24 is best seen having a body or stud section 50 and a cutter 52. The cutter 52 is generally similar to cutter 42 but is provided with multiple apexes 54, here shown as two, with a face 56 extending backwardly from both sides of each of the apexes 54. Again, it is preferable that the cutting element 24 having a zero degree side rake and a slight back rake such as 10° to provide positive cutting action and minimize slipping on hard formations.

The cutting element 24 because of its multiple apexes 54 or chisel points is better for drilling in hard formations than the single chisel surface of the cutting element 22 shown in FIGS. 3–5.

Referring again to FIG. 2, it is to be noted in one embodiment that the cutting elements 22 and 24 are inserted into the flat bottom 20 and distributed in staggering rotational and radial positions to provide a pattern to engage the entire surface of the formation to be drilled every complete rotation of 360° around the longitudinal axis of the bit 10. The arrangement shown in FIG. 2 provides a positioning arrangement in which the cutters 22 are alternately positioned with the cutters 24 outwardly in a radial direction from the longitudinal axis of the bit 10. This particular pattern provides for fast penetration rates combined with stability and suitability to cut stratified formations. The advantage this bit 10 design has over current designs is that the cutter combination (i.e., single and double apex) allows for the drilling of several types of formations with one bit. The uniqueness of the multiple cutter profiled bit is its versatility in drilling stratified formations consisting of strata of varying hardness. However, in drilling some types of formations only the single chisel profile cutters 22 would be used while in other harder types of formations the bit 10 may include only the multiple chisel shaped cutters 24.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. An earth drilling bit comprising, a body, said body having a flat bottom, a plurality of cutting elements positioned on the flat bottom, said elements including a stud carrying a polycrystalline diamond cutter, said cutters including an elongate straight, sharp chisel edged apex with a face on both sides of the apex extending backwardly from the apex, said apex extending generally vertically with a slight back rake for providing a chisel surface for acting on the earth even when the cutter becomes worn, wherein the cutters include multiple apexes with a face extending backwardly on both sides of each apex.

2. An earth drilling bit comprising, a body, said body including a flat bottom, a plurality of cutting elements positioned on the flat bottom, said elements including a stud carrying a polycrystalline diamond cutter, some of said cutters including a single straight sharp chisel edged apex with a face on both sides of the apex extending backwardly from the apex, and some of the cutters including multiple straight sharp chisel edged apexes with a face extending backwardly on both sides of each apex, all of said apexes extending generally vertically with a slight back rake for providing a chisel surface for acting on the earth even when the cutter becomes worn.

3. The apparatus of claim 2 wherein the plurality of cutting element are all in the same horizontal plane, and the cutters with a single apex are alternately positioned outwardly in a radial direction from the horizontal axis of the body with the cutters having multiple apexes.

4. An earth drilling bit comprising, a body having a bottom, a plurality of cutting elements positioned on the bottom, said elements including a stud carrying a polycrystalline diamond cutter, said cutters including an elongate straight sharp chisel edged apex with a face on both sides of the apex extending backwardly from the apex, said apex extending generally vertically with a slight back rake for providing a chisel surface which maintains its shape while acting on the earth even when the cutter becomes worn, wherein some of said cutters include multiple straight sharp apexes with a face extending backwardly on both sides of each apex.

* * * * *